US005210575A

United States Patent [19]

Kikuchi

[11] Patent Number: 5,210,575

[45] Date of Patent: May 11, 1993

[54] DEVELOPING APPARATUS INCLUDING A BLADE FOR FORMING A TONER LAYER

[75] Inventor: Kazuhiko Kikuchi, Yokohama, Japan

[73] Assignee: Kabushiki Kaisha Toshiba, Tokyo, Japan

[21] Appl. No.: 654,959

[22] Filed: Feb. 13, 1991

[30] Foreign Application Priority Data

Feb. 14, 1990 [JP] Japan ..... 2-32692

[51] Int. Cl.[5] ..... G03G 15/06

[52] U.S. Cl. ..... 355/259; 118/653; 355/245

[58] Field of Search ..... 355/245, 259, 260, 253; 118/653, 656, 644, 651, 261, 262

[56] References Cited

U.S. PATENT DOCUMENTS

| | | | |
|---|---|---|---|
| 3,152,012 | 10/1964 | Schaffert | 118/637 |
| 3,731,146 | 5/1973 | Bettiga et al. | 317/3 |
| 4,616,918 | 10/1986 | Kohyama et al. . | |
| 4,662,311 | 5/1987 | Shoji et al. | 118/651 |
| 4,920,916 | 5/1990 | Mizuno et al. | 118/653 |
| 4,967,231 | 10/1990 | Hosoya et al. | 355/259 X |
| 5,057,868 | 10/1991 | Sekino et al. | 355/245 X |

FOREIGN PATENT DOCUMENTS

| | | | |
|---|---|---|---|
| 0180407 | 5/1986 | European Pat. Off. . | |
| 60-46577 | 3/1985 | Japan . | |
| 0138580 | 5/1989 | Japan | 355/245 |
| 1-235975 | 9/1989 | Japan . | |
| 1-309080 | 12/1989 | Japan . | |

*Primary Examiner*—A. T. Grimley
*Assistant Examiner*—Sandra L. Brasé
*Attorney, Agent, or Firm*—Foley & Lardner

[57] ABSTRACT

A developing device having a developing roller facing an electrostatic latent image carrying body, and developing agent layer forming device brought into contact with the surface of the developing roller, the developing agent layer being put in contact with the electrostatic latent image carrying body thereby visualizing the latent image. The developing agent layer forming means comprises a thin-plate spring member and an elastic member of rubber or resin situated at a location away from the free end portion of the thin-plate spring member by 0.5 to 5 mm, which is put in contact with the surface of the developing roller.

7 Claims, 5 Drawing Sheets

DEVELOPING APPARATUS INCLUDING A BLADE FOR FORMING A TONER LAYER

BACKGROUND OF THE INVENTION

1. Field of the Invention

The present invention relates to a developing apparatus for visualizing latent images, which is employed in an electronic photographing apparatus or a static recording apparatus, and more particularly to a developing apparatus capable of obtaining high-quality images with use of a one-component developing agent.

2. Description of the Related Art

As a developing method using a one-component developing, agent, there an impression development method is known. This method is characterized in that a static latent image is contacted with toner particles or a toner-carrying body at a substantially zero relative peripheral velocity (see U.S. Pat. Nos. 3,152,012; 3,731,146; Published Unexamined Japanese Patent Application (PUJPA) No. 47-13088; PUJPA No. 47-13089; etc.). Since no magnetic material is needed, there are many advantages; for example, simplification and miniaturization of the apparatus, and easy use of color toner.

In the above impression development method, development is performed in the state wherein the toner carrying body is pressed on, or put in contact with, a latent image. Thus, it is necessary to use a developing roller with elasticity and electrical conductivity. In particular, when the latent image carrying body is rigid, it is imperative that the developing roller be formed of an elastic material in order to prevent damage to the latent image carrying body. In order to obtain well-known developing electrode and bias effects, it is desirable to provide an electrically conductive layer on or near the surface of the developing roller, and apply a bias voltage as needed. However, where the conductive layer is provided on the surface of the elastic roller, the conductive layer pressure-contacts the latent image carrying body or a blade for forming a toner thin film. Consequently, damage, such as scars, may occur. Even if the bias conductivity is maintained by using an electrically conductive elastic body, photographic density non-uniformity, fog or scars may appear on the produced image.

In the above impression developing method, there is proposed a blade for forming a toner thin layer, an end portion of the blade having a curvature. Since this type of blade has a curved portion which contacts the developing roller, the thickness of the toner layer can be made uniform without increasing a linear load. On the other hand, however, unless the straightness of the curved portion of the blade in its longitudinal direction is increased, the density non-uniformity or irregular formation of the toner layer may occur in the longitudinal direction.

SUMMARY OF THE INVENTION

The object of the present invention is to provide a developing apparatus capable of obtaining high-quality images free from density variation, fog, etc., wherein the image quality is not deteriorated even when the device is used for a long time and applied to high-speed operations.

According to a first embodiment of the present invention, there is provided a developing apparatus for developing an image on an image carrying body, comprising:

means, located to face the image carrying body, for supplying a developing agent to the image carrying body; and means for forming a developing agent layer of the developing agent supplied to the image carrying body on the supplying means, the forming means having an elastic member for controlling the thickness of the developing agent layer on the supplying means and a supporting member for supporting the elastic member, the supporting member having a free end portion facing the supplying means and a supporting portion supporting the elastic member thereon such that the supporting portion is away from the free end portion by 0.5 to 5 mm.

According to a second embodiment of the invention, there is provided a developing apparatus for developing an image on an image carrying body, comprising:

means, located to face the image carrying body, for supplying a developing agent to the image carrying body; and means for forming a developing agent layer of the developing agent supplied to the image carrying body on the supplying means, the forming means having an elastic member for controlling a thickness of the developing agent layer on the supplying means and a supporting member for supporting the elastic member, the supporting member having a free end portion facing to the supplying means and a supporting portion supporting the elastic member thereon, and said supporting member having a longitudinal width decreasing towards the side of the supporting member which is put in contact with the supplying means.

According to a third embodiment of the invention, there is provided a developing apparatus for developing an image on an image carrying body, comprising:

means, located to face the image carrying body, for supplying a developing agent to the image carrying body; and means for forming a developing agent layer of the developing agent supplied to the image carrying body on the supplying means, the forming means having an elastic member for controlling the thickness of the developing agent layer on the supplying means and a supporting member for supporting the elastic member the supporting member having a free end portion facing the supplying means and a supporting portion supporting the elastic member thereon, the longitudinal width of the elastic member being less that that of the supporting member, the longitudinal width Lp of the supporting member and the longitudinal width Lc of the elastic member satisfying the formula, 30 $(mm) > Lc - Lp \geqq 4$ $(mm)$, in which there are regions at both end portions of the supporting member, where the elastic member is not provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below,, serve to explain the principles of the invention.

DETAILED DESCRIPTION OF THE PREFERRED EMBODIMENTS

The developing device of the present invention comprises a developing roller situated to face an electrostatic latent image carrying body, and means, brought into contact with the surface of the developing roller, for forming a developing agent layer on the surface of the developing roller, the developing agent layer being put in contact with the electrostatic latent image carrying body thereby visualizing the latent image.

In the developing device according to a first embodiment of the invention, the means for forming the developing agent layer on the surface of the developing roller comprises a thin-plate spring member and an elastic member of rubber or resin situated at a location away from that free end portion of the thin-plate spring member by 0.5 to 5 mm, which is put in contact with the surface of the developing roller.

Thus, the elastic member can be precisely mounted at the end portion of the thin-plate spring member by means of molding or adhesion, and, as a result, a developing agent layer with a uniform thickness can be formed.

In the developing device according to a second embodiment of the invention, the means for forming the developing agent layer on the surface of the developing roller comprises a thin-plate spring member and an elastic member of rubber or resin situated at an end portion of the thin-plate spring member. The thin-plate spring member has a longitudinal width decreasing towards the side of the spring member which is put in contact with the developing roller.

Thus, a uniform pressure can be applied by the developing agent layer forming means onto the developing roller, and a developing agent layer with a uniform thickness can be formed.

In the developing device according to a third embodiment of the invention, the means for forming the developing agent layer on the surface of the developing roller comprises a thin-plate spring member and an elastic member of rubber or resin situated at an end portion of the thin-plate spring member. The longitudinal width of the elastic member is less than that of the thin-plate spring member, the longitudinal width Lp of the thin-plate spring member and the longitudinal width Lc of the elastic member satisfy the formula, $30 > Lc - Lp \geqq 4$, and there are regions at both end portions of the thin-plate spring member, where the elastic member is not provided.

Thus, sealing members can be attached to the regions at both end portions of the thin-plate spring member, where the elastic member is not provided. Thus, the dropping of developing agent can be effectively prevented, and the formation of undesirable images due to dropping of developing agent can be prevented.

Preferred embodiments of the present invention will now be described in detail with reference to the accompanying drawings.

Figure 1:
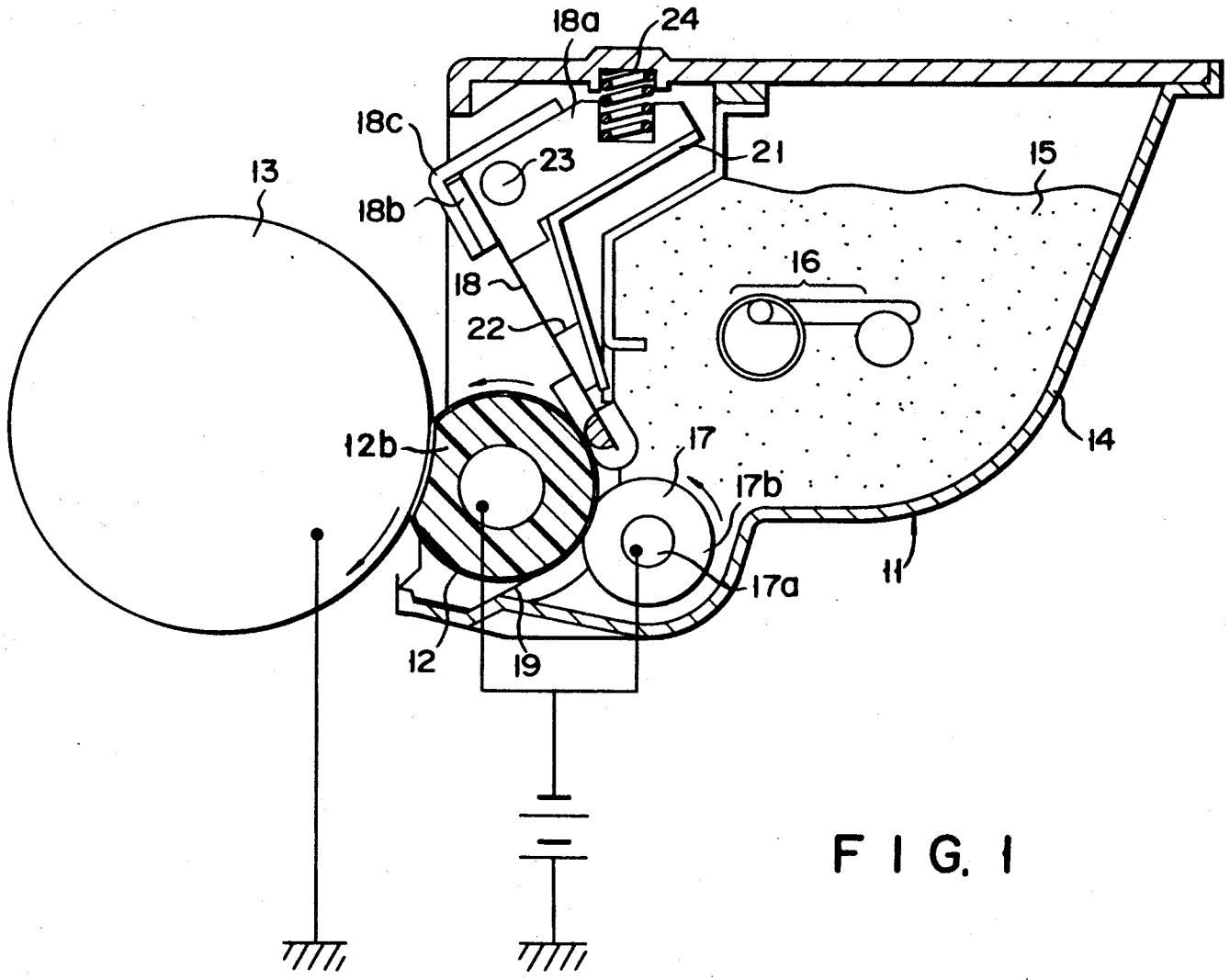
FIG. 1 is a cross-sectional view showing a developing device according to one embodiment of the present invention.

FIG. 1 is a cross-sectional view showing a contact-type one-component non-magnetic developing device according to an embodiment of the present invention.

Referring to FIG. 1, developing device 11 has a developing roller 12 with electrical conductivity and elasticity. A thin layer of a toner or a one-component non-magnetic developing agent is formed on the surface of the developing roller 12. The thin layer of toner is brought into contact with the surface of a photosensitive body 13, thereby developing a static latent image on the surface of the photosensitive body 13. Since the developing device 11 does not require a carrier, a magnet roller, means for toner density control, etc., the size and manufacturing cost thereof can be reduced.

The development process using the development device 11 will now be described.

Non-magnetic toner 15 within a toner container 14 is stirred by a mixer 16 and supplied to a toner supply roller 17. After the toner 15 has been fed to the developing roller 12 by means of the toner supply roller 17, the toner 15 is charged by friction with the surface of the developing roller 12. The toner 15 electrostatically adhered to the surface of the developing roller 12 is transferred. Then, the quantity of toner to be transferred is limited by a blade 18 and simultaneously the frictional charge of toner 15 is effected by friction between the blade 18 and developing roller 12. The blade 18 is held by a first blade holder 18*a*, a spacer 18*b* and a second blade holder 18*c* and is pressed in contact with the developing roller 12.

According to this embodiment, reverse development is employed using organic photosensitive body 13 which is negatively charged. Thus, a negative charge toner is used as toner 15, and blade 18 is formed of a material which is easily charged to a negative potential. The surface potential of photosensitive drum 13 is −550 V, while the development bias voltage is −200 V. The development bias is applied to a metallic shaft 12*a* of the developing roller 12 through a protection resistor.

The developing roller 12 is rotated in the direction of an arrow (in FIG. 1) at about one to four times the circumferential speed of photosensitive drum 13, in contact with the drum 13. There is provided a contact width (development nip width) of about one to 5 mm between itself and the drum 13. Since the toner particles are charged by friction at the development position, a sharp image with very little fog can be obtained. The toner remaining after development passes through a recovery blade (Mylar film) 19 and returns into the developing device.

If toner falls from the developing roller 12 owing to some cause, it would dirty the inside of the apparatus body or sheets. In order to solve this problem, a member made of such a plasticizer or the like as to react with and fusion-bond toner is disposed under the developing device. Even if the developing device 11 is vertically inverted, toner does not fall.

In FIG. 1, numeral 21 denotes a baffle plate attached to the first blade holder 18*a*. The baffle plate 21 is in contact with a foamed material member 22, such as Mortprene, attached to the rear surface of the blade 18, thereby preventing penetration of toner and vibration of blade 18. Thus, a desirable toner layer can be formed on the developing roller 12. The blade 18 is pressed on the developing roller 12 by means of a rotational shaft 23 of first blade holder 18*a* and a plurality of compression springs 24. Since the springs 24 have a spring constant lower than that of a thin-plate spring of blade 18, the pressing force of springs 24 provides little change even if the contact part of blade 18 is worn. Thus, a desirable toner layer can be formed for a long time.

The details of main structural parts of the developing device 11 shown in FIG. 1 will now be described.

Figure 2:
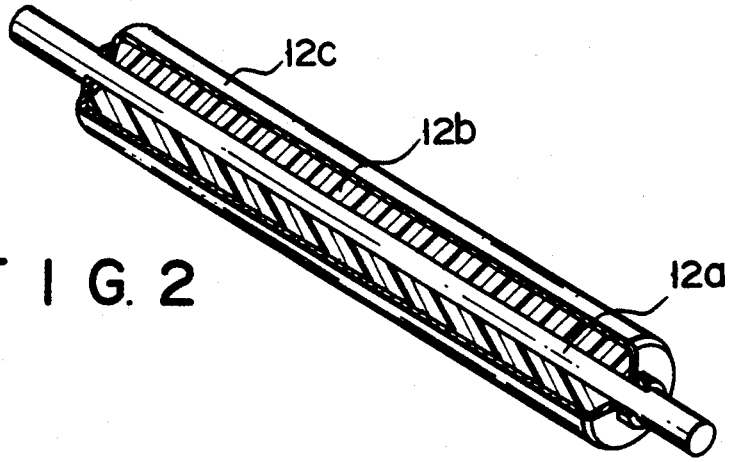
FIG. 2 is a perspective cross-sectional view showing an embodiment of a developing roller according to this invention.

FIG. 2 is a perspective cross-sectional view of developing roller 12 which is a structural part of developing device 11 shown in FIG. 1.

In the development method adopted in this developing device, the most important characteristic of the developing roller 12 is "possession of electrical conductivity and elasticity." The simplest structure for providing this characteristic is a combination of a concentrically arranged metallic shaft and electrically conductive rubber roller. In this structure, however, the smoothness of the surface of developing roller 12 is required since toner is contacted with and transferred by the surface of the developing roller. In the present invention, as shown in FIG. 2, a double-layer structure of an elastic layer 12*b* and a surface conductive layer 12*c* is disposed around a metallic shaft 12*a*.

The elastic layer 12*b* may be electrically conductive or may not. In this embodiment, the layer 12*b* is made conductive, taking peeling or scar of the conductive layer 12*c* into account. The elastic layer 12*b* is pressed in contact with the blade 18 and photosensitive drum 13 and, therefore, if the rubber hardness thereof is high, a high charge is required to obtain a predetermined nip width and the developing device torque is increased. In addition, a permanent deformation [%] (JISK6301) due to packaging and long-time holding is a significant problem. If the deformation exceeds 10%, a density non-uniformity due to developing roller cycles appears on images. Thus, the compression permanent deformation [%] of elastic layer 12*b* must be limited to 10% or less, and preferably 5% or less. The rubber hardness and permanent deformation [%] have such a general relationship that the permanent deformation decreases as the rubber hardness increases. Therefore, the balance of hardness and permanent deformation of material is important.

The developing roller 12 is deformed by the blade 18 and then brought to the developing part of photosensitive drum 13. In this case, if the roller 12 is brought to the developing position while it remains deformed, development would be adversely affected. Thus, the original shape of the deformed roller 12 must be recovered before the roller 12 is brought to the developing position. It is therefore desirable that the rubber hardness of elastic layer 12*b* be 35°, or less, and preferably 30°, and the rubber hardness of conductive layer 12*c* be 35°, or less, and preferably 30°, or less.

The electrically conductive layer 12*c* is formed by coating the surface of the elastic layer 12*b* with an electrically conductive polyurethane-based material by means of spray coating or dipping. Since this conductive layer 12*c* contacts both the toner and photosensitive body directly, the layer 12*c* must be prevented from contaminating the toner and photosensitive body owing to exudation of plasticizer, curing agent, process oil, etc. It is desirable that the smoothness of the surface of conductive layer 12*c* be 3 μmRz or less. If the smoothness is greater than this value, the roughness of the surface of layer 12*c* is liable to appear on images. The smoothness of 3 μmRz can be obtained by forming a sufficiently thick conductive layer 12*c* on the surface of elastic layer 12*b* and after-treating (polishing) it so as to have a predetermined outside diameter and surface roughness. This process, however, is costly. In order to attain this smoothness without after-treatment, it is necessary to set to optimal values the surface roughness of elastic layer 12*b*, the thickness of conductive layer 12*c* and the viscosity of the coating on layer 12*c*. In other words, the thickness of conductive layer 12*c* must be increased as the viscosity of the coating lowers and the surface roughness of elastic layer 12*b* increases.

Figure 3A:
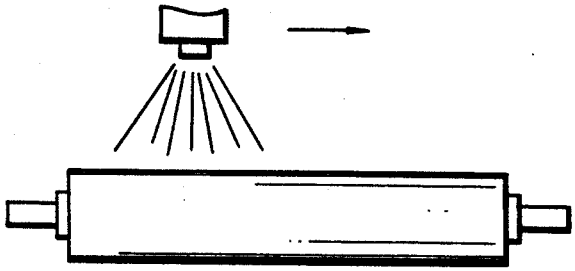
FIGS. 3A to 3C illustrate a method of forming an electrically conductive layer of the developing roller according to the invention.
Figure 3B:
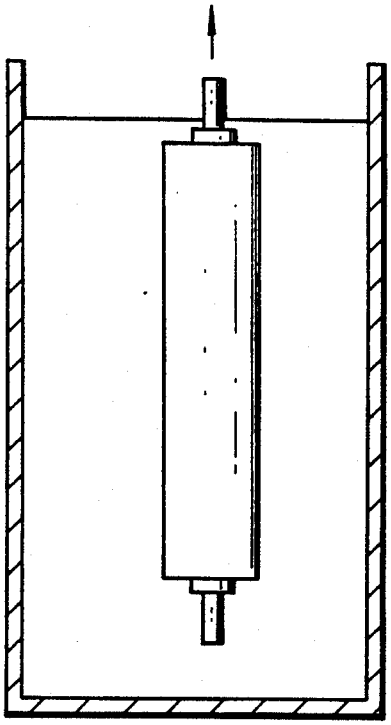
Figure 3C:
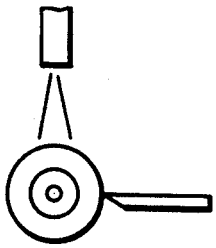

The viscosity of the coating material for forming the electrically conductive layer 12*c* must be varied (by altering the rate of dilution), even if the coating material is unchanged, in accordance with the method of coating the material on the surface of the elastic layer 12*b*. FIGS. 3A to 3C illustrate typical coating method.

FIG. 3A illustrates a spray coating method, FIG. 3B a dipping method, and FIG. 3C a knife edge method. It is necessary that the viscosities of coating materials be in the order of the spray coating method < dipping method ≦ knife edge method. Assuming that the surface roughness of elastic layer 12*b* is S [μmRz], the film thickness T [μm] of the coating necessary for achieving the surface smoothness 3 μmRz of conductive layer 12*c* is $T \geqq 5 \times S$ in the spray method and $T \geqq 3 \times S$ in the dipping method and knife edge method. Thus, the developing roller 12 can be provided at a low cost.

A film thickness of 150.0 μm or less is desirable for rubber with hardness of 35° or less. If the film thickness is greater than this, the conductive layer 12*c* cannot follow the elastic deformation of the rubber, and wrinkles or cracks may be produced. In addition, the extension [%] of material itself of conductive layer 12*c* is a problem. If the extension is 50% or less, the conductive layer 12*c* cannot follow the elastic deformation of the rubber of elastic layer 12*b*, as mentioned above, and, in particular, cracks are liable to form at both end portions where elastic deformation is large. Unless the difference between the extension [%] of rubber material of elastic layer 12*b* and the extension [%] of electrically conductive layer 1*c* is 200 or less, that is, unless the relationship, $L_E - L_L < 200$ (where $L_E$ and $L_L$ denote the respective extensions [%]), is satisfied, the conductive layer 12*c* cannot follow the elastic deformation of elastic layer 12*b*, and cracks may form. If this formula is not satisfied, the recovery of the developing roller 1 after deformation is slow and the rubber hardness of the developing roller 12 increases. Thus, a density variation is liable to occur over a single rotation of the developing roller 12.

Figure 4:
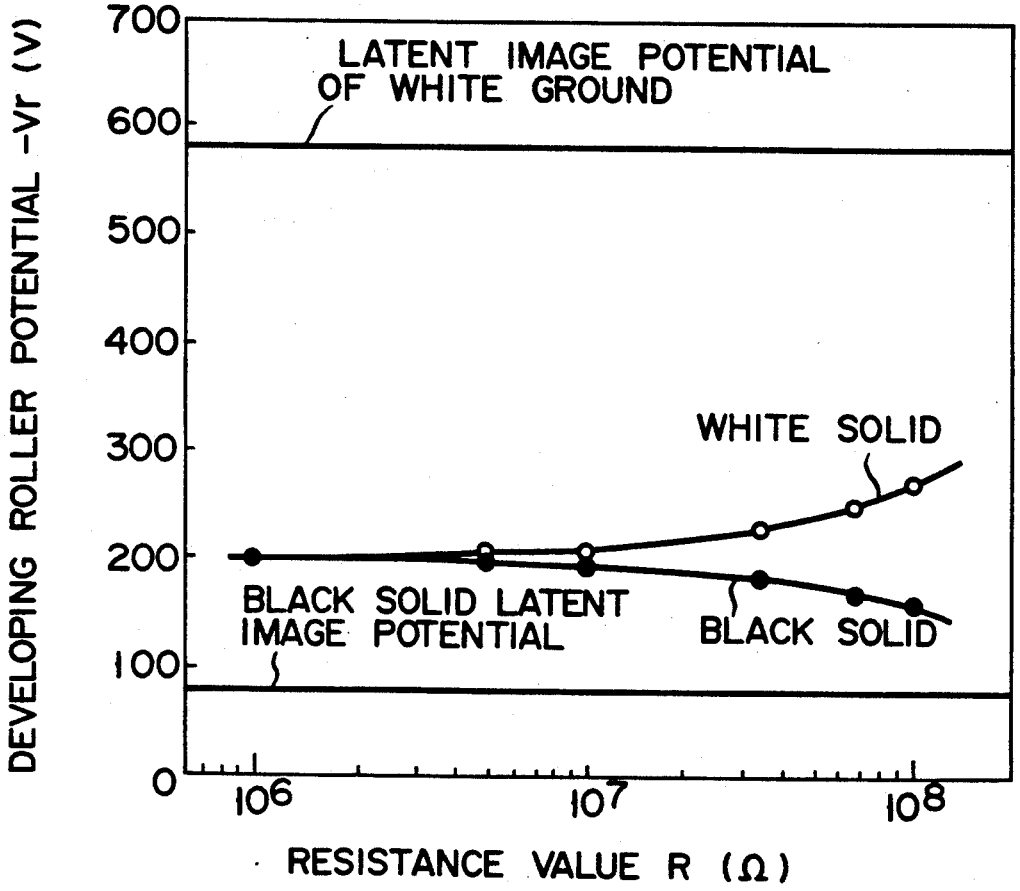
FIG. 4 is a graph illustrating the relationship between the potential and resistance on the surface of the developing roller, according to the embodiment of the developing device of the invention, and the image.

Since toner is negatively charged in this embodiment, it is necessary that the conductive layer 12*c* be formed of a material which tends to be positively charged by friction and which can advantageously carry toner. Regarding the resistance between the metallic shaft 12a and the surface of conductive layer 12c, which is a characteristic of the developing roller 12, a resistor of a given resistance is interposed between a development bias power source and metallic shaft 12 for experimenting with development. Thus, the relationship between the surface potential of the developing roller and images was found, which is shown in FIG. 4. The voltage of the development bias power source at this time is −200 V.

As is obvious from FIG. 4, where the resistance value of the resistor interposed between the development bias power source and metallic shaft 12 is $10^7$ Q or more, the developing roller 12 has different surface potentials at the time of developing a while solid image and a black solid image. The surface potential tends to approach a white ground latent image potential in the while solid image, and to approach a black solid latent image potential at the black solid image. In other words, in the case of an image having a large-area image part, the difference between the image-part latent image potential and the developing roller surface potential is decreased, resulting in an image with a low density. By contrast, in the case of a fine-line image or the like having a small-area image part, the developing roller surface potential approaches a white ground latent image potential and the potential difference between the roller surface potential and the image part potential increases. Thus, a fine line thickens, resulting an unclear image.

The variation in surface potential of developing roller 12 is due to a current flowing through the resistor during development. At the time of developing a black solid image, negatively charged toner particles are transferred from the developing roller 12 to the photosensitive drum 13. Thus, an electric current is caused to flow from the developing roller 12 to the development bias power source. At the time of developing a total white image, the surface charge on the photosensitive drum 13 is eliminated, and an electric current is caused to flow from the development bias power source to the developing roller 12. This current provides a potential difference between both ends of the resistor, and the above-mentioned variation of the surface potential of the developing roller 12 is caused.

This tendency is conspicuous at the resistance value of $1\times10^8$ Q or above. Specifically, an excellent image was obtained when the actual resistance value between the metallic shaft 12a and surface conductive layer 12c is $1\times10^8$ Q or less, and preferably $1\times10^7$ Q or less.

More specifically, since the resistance value between the metallic shaft 12a and surface conductive layer 12c is $1\times10^8$ Q or less, the resistance values of the electrically conductive elastic layer 12b and surface conductive layer 12c should practically much lower than $1\times10^8$ Ω·cm, because of the presence of an adhesive layer and primer layer interposed between the metallic shaft 12a and elastic layer 12b and between the elastic layer 12b and conductive layer 12c. In the present invention, satisfactory results are obtained if the resistance values are $1\times10^6$ Ω·cm.

In the developing roller 12 of the present invention, the elastic layer 12b is made of an electrically conductive silicone rubber having a rubber hardness of 25° to 35°, an extension of about 250 to 500% and a resistance value of $10^6$ Ω·cm. The electrically conductive layer 12cc is made of an electrically conductive polyurethane coating material, for example, "Sparex" (trademark) (manufactured by Nippon Miracton Co., Ltd.) having a resistance value of $10^4$ to $10^5$ Ω·cm and an extension of 100 to 400%. The rubber hardness of the developing roller 12 is about 30° to 45°. The electrically conductive layer 12c having a thickness of about 50 to 120 μm is formed, by means of spray coating, on the elastic layer 12b having a surface roughness of 5 to 10 μmRz. Thus, the developing roller 12 with surface roughness of 3 μmRz can be obtained, and excellent images can be obtained.

In the present invention, the developing roller 12 is constituted by applying the electrically conductive silicone rubber and electrically conductive polyurethane coating onto the metallic shaft. However, the structure of the developing roller 12 is not limited to this, only if the above-stated characteristic is satisfied.

Next, the blade 18 and its peripheral parts in the developing device 11 shown in FIG. 1 will now be described.

Figure 5:
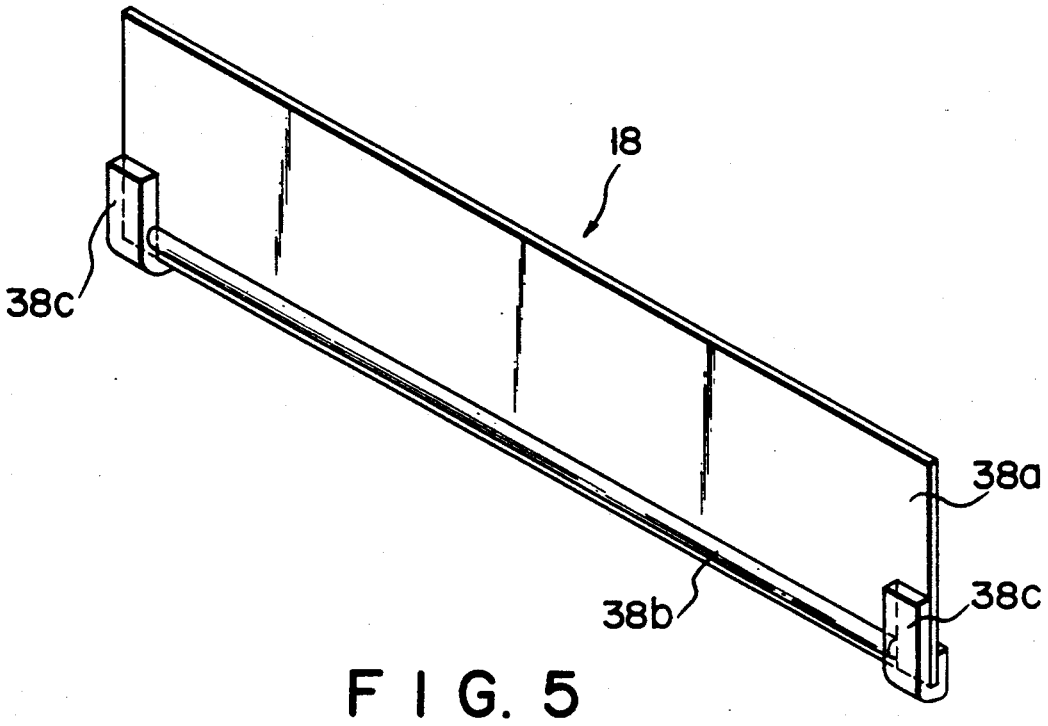
FIG. 5 is a perspective view of a blade according to the embodiment of the developing device of the invention.

FIG. 5 is a perspective view showing the details of the blade 18. The blade 18 is constituted such that a chip 38b having a semicircular, parabolic, oval or plate-like cross section and made of rubber elastic material or resin, such as silicone rubber, silicone resin, polyurethane rubber, polyurethane resin, fluorine rubber or fluorine resin, is mounted at an edge portion of a thin-plate spring 38a of stainless steel or phosphor bronze along the longitudinal axis, and seal members 38c made of polyurethane foam, etc. are attached to both end portions of the spring 38a.

The thickness of each of the seal members 38c is greater than the thickness of the chip 38b with a semicircular cross section. Since the seal member 38c has larger elasticity than the chip 38b, the seal member 38c and the chip 38b contact the developing roller 12. The seal members 38c prevent toner from moving in the longitudinal direction of chip 38b when the chip 38b is pressed in contact with the roller 12. Regarding blade 18, unless the chip 38b with semicircular cross section is pressed into contact with the developing roller 12, a non-uniform toner layer may be formed. Thus, precision of that part of chip 38b, which is brought in contact with the developing roller 18, is required. The experiments showed that the non-uniformity of toner layer can be reduced to a negligible level if the straightness is 50 μm or less. However, the precision of the blade, as disclosed in the above-mentioned U S. Pat. No. 3,152,012, is 100 μm at a maximum.

On the other hand, in the blade 18 of the present embodiment, the chip 38b with semicircular cross section is mounted on the thin-plate spring 38a. Thus, even if the precision of the chip 38b is about 100 μm, a uniform toner layer can easily and surely be formed by virtue of elasticity of the thin-plate spring 38a. Though precision in the direction of the normal line to the tangential line of the developing roller 12 and chip 38b can easily be corrected, as stated above, the precision in the direction of the tangential line may lead to a pressure variation.

Figure 6:
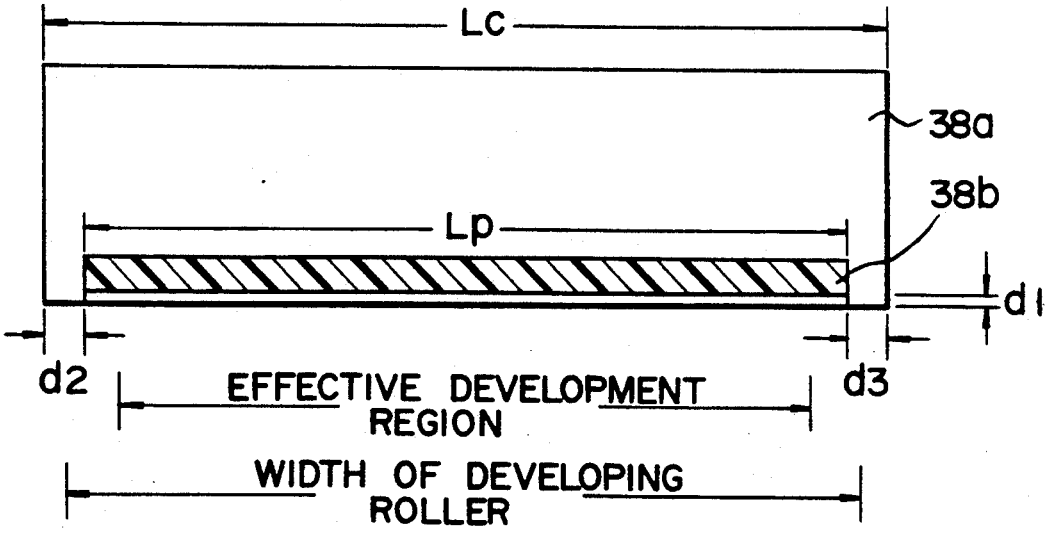
FIG. 6 shows in detail the blade according to the embodiment of the developing device of the invention.

Under this situation, in the blade 18 of the present embodiment, as shown in FIG. 6, the chip 38b is mounted from the location which is away from the end of thin-plate spring 38a by a distance d1. In addition, the chip 38b is used for holding or positioning when the spring 38a is mounted by molding or adhesion or the like. Thus, the mount precision in the transverse direction of the thin-plate spring, as well as the precision in the tangential direction of the developing roller 12 and chip 38*b*, can be enhanced. If the distance d1 is too large, a good layer cannot be formed owing to the pressure of toner flow. The distance d1 should be about 0.5 to 5 mm, and preferably about 0.5 to 2 mm.

The longitudinal length Lp of the chip 38*b* is shorter than the longitudinal length Lc of the thin-plate spring 38*a* by d2+d3. Specifically, $Lc=Lp+d2+d3$. The above-mentioned seal members 38*c* are attached to the regions of d2 and d3. If the length of d2+d3 is too large, the size of the developing device increases. Considering the seal width, at least 2 mm is necessary on one side. Thus, d2+d3 should be 4 to 30 mm, and desirably 4 to 20 mm. If the d2+d3 is less than 4 mm, the seal effect is weak. On the other hand, if the d2+d3 exceeds 30 mm, the size of the apparatus becomes too large.

The length Lp of the chip 38*b* is greater than the effective development width and the length Lc of the thin-plate spring 38*a* is equal to the width of the developing roller 12 is so set as to overlap the side seal (not shown) of the developing roller 12.

Figure 7:
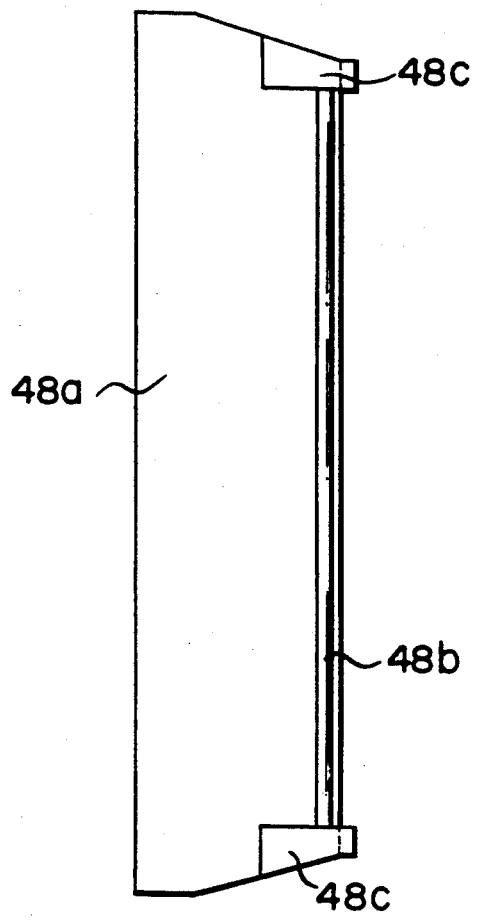
FIG. 7 shows another example of the blade of the developing device of the invention.
Figure 8:
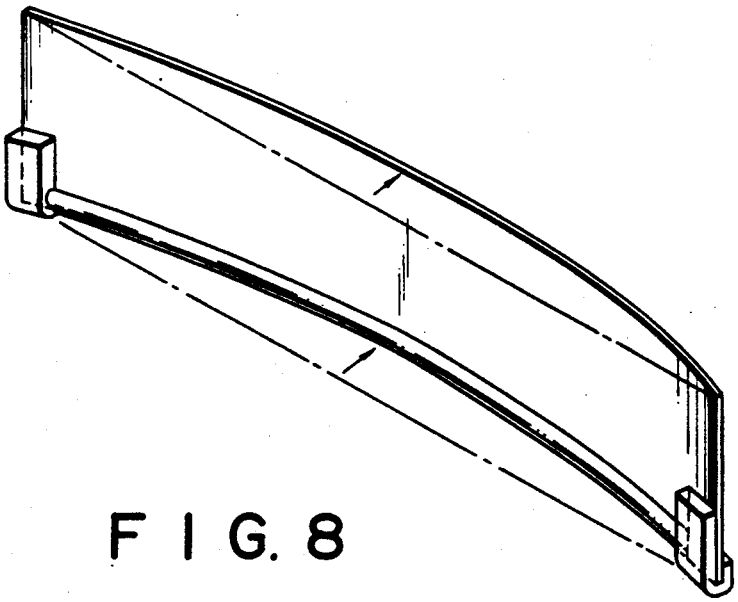
FIG. 8 shows a modification of the blade of the developing device of the invention.

FIG. 7 shows another embodiment of the blade 18 of the present invention. In general, when a thin-plate spring 48*a* is pressed in contact with an object, the pressure is greater at end portions than at a center portion of the object. The same is applicable to this embodiment wherein a pressure-contact portion includes a chip 48*b* having rubber elasticity or formed of resin. When the chip 48*b* is mounted by means of molding, the material of chip 48*b* contracts, and chip 48*b* is curved in the direction of an arrow (FIG. 8). Thus, pressure at end portions increases. By contrast, by shaping the thin-plate spring 48*a* such that the width of the spring 48*a* decreases towards the contact portion with the developing roller 12, as shown in FIG. 7, the curvature of chip 48*b* can be decreased by a pressure difference between the end portions and center portion. Further, a toner layer on the developing roller 12 can be made uniform.

In the above-described embodiment, the cross section of the chip 38*b*, 48*b* of blade 18 is semicircular. However, the cross section is not limited to this. Only if the contact portion of the chip with the developing roller 12 is not flat, the chip may have a parabolic or oval face.

The toner supply roller 17, as stated above, has the function of supplying toner to the developing roller 12 and the function of scraping the toner on the roller 12 after development. Thus, the toner supply roller 17 is constituted such that a soft polyurethane foamed layer 17*b* having an electrical conductivity of $10^6$ Ωcm or less, a density of 0.045 g/cm$^2$ and a cell number of about 60 cells/25 mm is formed around a metallic shaft 17*a*. The depth of contact of the roller 17 with the developing roller 12 is about 0.2 to 1.0 mm, and the rotational speed of the roller 17 is ½ of or equal to that of the developing roller 12, with the directions of rotation reverse to each other. A bias voltage of a potential equal to that applied to the developing roller is applied to the toner supply roller 17, thereby obtaining excellent images.

According to the above-described embodiment of the invention, the position of the blade 18 is against the direction of rotation of the developing roller 12; however, the position of blade 18 may be with the direction of rotation of the developing roller 12.

As has been described above, according to this invention, it is possible to obtain high-quality images free from density variation, fog, etc.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A developing apparatus for developing an image on an image carrying body, comprising:

means, located to face the image carrying body, for supplying a developing agent to the image carrying body; and means for forming a developing agent layer of the developing agent supplied to the image carrying body on the supplying means, the forming means having an elastic member for controlling a thickness of the developing agent layer on the supplying means and a supporting member for supporting the elastic member, the supporting member having a free end portion facing to the supplying means and a supporting portion supporting the elastic member thereon, and said supporting member having a longitudinal width decreasing towards the portion of the supporting member which is put in contact with the supplying means.

2. A developing apparatus for developing an image on an image carrying body, comprising:

a developing roller for supplying a developing agent to the image carrying body, the developing roller being located to face the image carrying body;

a developing agent supplying roller for supplying the developing agent to the developing roller; and means for forming a developing agent layer of the developing agent supplied to the image carrying body on the developing roller, the forming means having an elastic member for controlling a thickness of the developing agent layer on the developing roller and a supporting member for supporting the elastic member, the elastic member having a semicircular cross section, and the supporting member having a free end portion facing the developing roller and a supporting portion supporting the elastic member thereon, the longitudinal width of the elastic member being less than that of the supporting member, the longitudinal width Lc of the supporting member and the longitudinal width Lp of the elastic member satisfying the formula 30 $(mm)>Lc-Lp\geqq 4$ $(mm)$, in which there are regions at both end portions of the supporting member, where the elastic member is not provided.

3. The developing apparatus according to claim 2, wherein said supporting portion is located away from the free end portion by 0.5 to 5 mm.

4. The developing apparatus according to claim 2, wherein said supporting member is composed of stainless steel or phosphor bronze.

5. The developing apparatus according to claim 2, wherein said elastic member is composed of a material selected from among the group consisting of silicone rubber, silicone resin, polyurethane rubber, polyurethane resin, fluorine rubber and fluorine resin.

6. The developing apparatus according to claim 2, wherein sealing members are provided at both sides of an end portion of the supporting member, thereby preventing lateral movement of the developing agent.

7. A developing apparatus for developing an image on an image carrying body, comprising:

a developing roller for supplying a developing agent to the image carrying body, the developing roller being located to face the image carrying body and having an elastic layer and a conductive surface layer formed on the elastic layer;

a developing agent supplying roller for supplying the developing agent to the developing roller; and means for forming a developing agent layer of the developing agent supplied to the image carrying body on the developing roller, the forming means having an elastic member for controlling a thickness of the developing agent layer on the developing roller and a supporting member for supporting the elastic member, the elastic member having a semicircular cross section, and the supporting member having a free end portion facing the developing roller and a supporting portion supporting the elastic member thereon, the longitudinal width of the elastic member being less than that of the supporting member, the longitudinal width Lc of the supporting member and the longitudinal width Lp of the elastic member satisfying the formula, $(mm) > Lc - Lp \geqq 4\ (mm)$, in which there are regions at both end portions of the supporting member, where the elastic member is not provided.

* * * * *